US010428759B2

(12) United States Patent
Kiuchi

(10) Patent No.: US 10,428,759 B2
(45) Date of Patent: Oct. 1, 2019

(54) FUEL CONTROL DEVICE FOR INTERNAL COMBUSTION ENGINE

(71) Applicant: Hitachi Automotive Systems, Ltd., Hitachinaka-shi, Ibaraki (JP)

(72) Inventor: Kazuki Kiuchi, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 320 days.

(21) Appl. No.: 15/532,589

(22) PCT Filed: Nov. 25, 2015

(86) PCT No.: PCT/JP2015/082971
§ 371 (c)(1),
(2) Date: Jun. 2, 2017

(87) PCT Pub. No.: WO2016/093056
PCT Pub. Date: Jun. 16, 2016

(65) Prior Publication Data

US 2017/0335789 A1 Nov. 23, 2017

(30) Foreign Application Priority Data

Dec. 8, 2014 (JP) ..... 2014-247564

(51) Int. Cl.
*F02D 41/20* (2006.01)
*F02D 41/40* (2006.01)
(Continued)

(52) U.S. Cl.
CPC ..... *F02D 41/401* (2013.01); *F02D 41/062* (2013.01); *F02D 41/20* (2013.01);
(Continued)

(58) Field of Classification Search
CPC ..... F02D 41/20; F02D 2041/2003; F02D 2041/2006; F02D 2041/2013;
(Continued)

(56) References Cited

U.S. PATENT DOCUMENTS 4,604,675 A 8/1986 Pflederer
10,267,253 B2 * 4/2019 Okonogi ..... F02D 41/22
(Continued)

FOREIGN PATENT DOCUMENTS

DE 101 49 982 A1 4/2003
DE 10 2010 017 093 A1 12/2010
(Continued)

OTHER PUBLICATIONS

Extended European Search Report issued in counterpart European Application No. 15868540.4 dated Jun. 21, 2018 (seven (7) pages).
(Continued)

*Primary Examiner* — Thomas N Moulis
(74) *Attorney, Agent, or Firm* — Crowell & Moring LLP

(57) ABSTRACT

Provided is a fuel control device for an internal combustion engine that is able to detect the correct boost voltage regardless of the temperature condition, and stabilize the boost voltage value, and is able to inject an accurate amount of fuel from a fuel injection valve. The boost voltage value detected when current is not flowing in a boosting capacitor at least during a boosting operation is taken as a legitimate boost voltage value, and this legitimate boost voltage value is compared with a prescribed boost voltage value to control the boosting operation. Thus, it is possible to stabilize the boost voltage at a legitimate boost voltage value regardless of the temperature condition, and it is possible to inject an accurate amount of fuel from a fuel injection valve, thereby improving fuel consumption.

6 Claims, 10 Drawing Sheets

(51) Int. Cl.

| | |
|---|---|
| ***F02D 41/06*** | (2006.01) |
| *F02D 35/02* | (2006.01) |
| *F02D 41/38* | (2006.01) |
| *H01F 7/18* | (2006.01) |

(52) U.S. Cl.
CPC ..... *F02D 35/023* (2013.01); *F02D 41/064* (2013.01); *F02D 2041/2003* (2013.01); *F02D 2041/2006* (2013.01); *F02D 2041/2051* (2013.01); *F02D 2041/389* (2013.01); *F02D 2200/021* (2013.01); *F02D 2200/0802* (2013.01); *F02D 2250/14* (2013.01); *H01F 2007/1822* (2013.01)

(58) Field of Classification Search
CPC ..... F02D 2041/2065; F02D 41/2051; F02D 2200/021
See application file for complete search history.

(56) References Cited

U.S. PATENT DOCUMENTS

| | | | | |
|---|---|---|---|---|
| 2009/0183714 | A1* | 7/2009 | Mayuzumi | F02D 41/20 123/490 |
| 2010/0242920 | A1* | 9/2010 | Omori | F02D 41/20 123/490 |
| 2011/0220069 | A1* | 9/2011 | Hatanaka | F02D 41/20 123/490 |
| 2014/0067233 | A1 | 3/2014 | Nishida et al. | |
| 2016/0237937 | A1* | 8/2016 | Kusakabe | F02D 41/20 |
| 2016/0240299 | A1* | 8/2016 | Wakai | H01F 7/064 |
| 2018/0230923 | A1* | 8/2018 | Tsukio | F02D 41/20 |

FOREIGN PATENT DOCUMENTS

| | | | |
|---|---|---|---|
| DE | 10 2013 204 005 | A1 | 3/2014 |
| DE | 10 2016 202 350 | A1 | 8/2016 |
| JP | 2007-146721 | A | 6/2007 |
| JP | 2013-36398 | A | 2/2013 |
| JP | 2014-214693 | A | 11/2014 |

OTHER PUBLICATIONS

International Search Report (PCT/ISA/210) issued in PCT Application No. PCT/JP2015/082971 dated Feb. 16, 2016 with English translation (Two (2) pages).

Japanese-language Written Opinion (PCT/ISA/210) issued in PCT Application No. PCT/JP2015/082971 dated Feb. 16, 2016 (Three (3) pages).

* cited by examiner

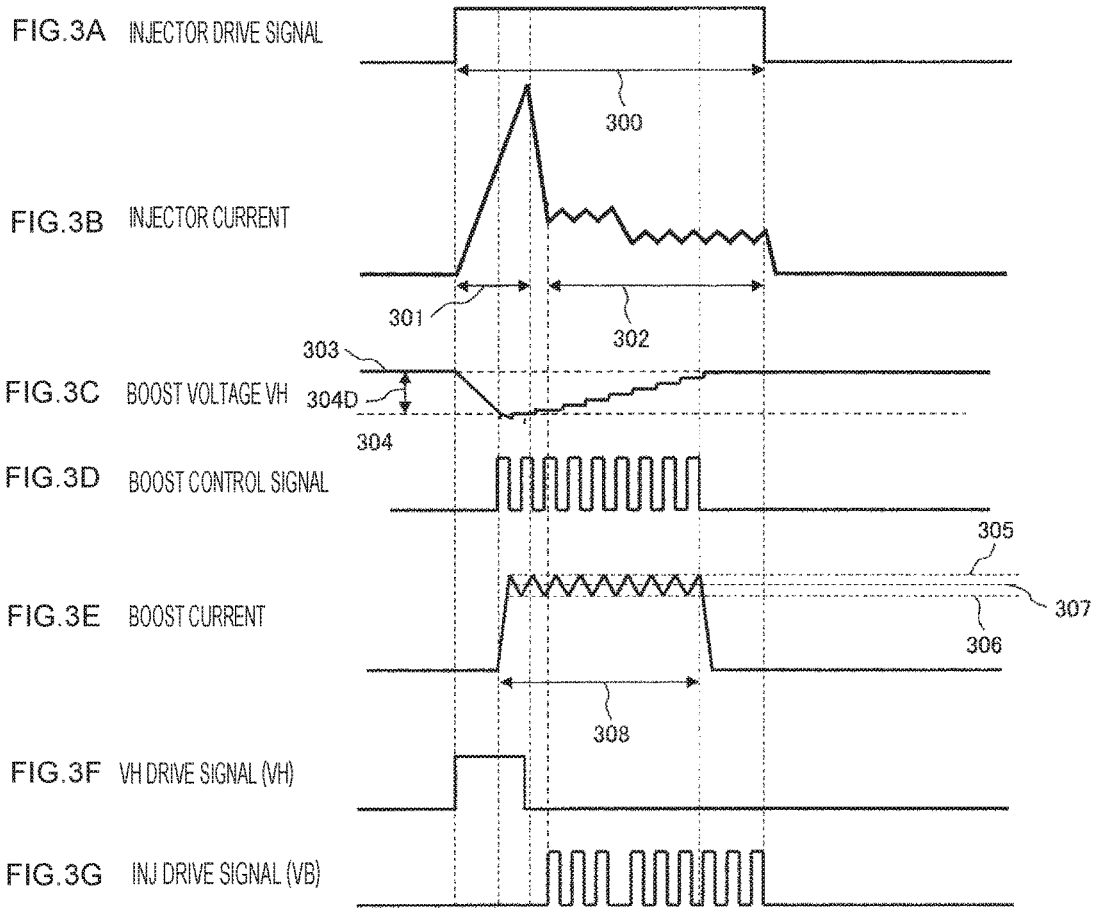
FIG.3A INJECTOR DRIVE SIGNAL
300
FIG.3B INJECTOR CURRENT
301
302
303
FIG.3C BOOST VOLTAGE VH
304D
304
FIG.3D BOOST CONTROL SIGNAL
305
FIG.3E BOOST CURRENT
307
306
308
FIG.3F VH DRIVE SIGNAL (VH)
FIG.3G INJ DRIVE SIGNAL (VB)

FUEL CONTROL DEVICE FOR INTERNAL COMBUSTION ENGINE

TECHNICAL FIELD

The present invention relates to a fuel control device for an internal combustion engine, and particularly relates to a fuel control device for an internal combustion engine which is used in the internal combustion engine which directly injects fuel from a fuel injection valve inside a cylinder.

BACKGROUND ART

For current automobiles, there is a request for reduction of harmful exhaust gas substances, such as carbon monoxide (CO), hydrocarbon (HC), and nitrogen oxides (NOx), contained in an exhaust gas of the automobile from a viewpoint of environment protection. In order for such reduction, an in-cylinder injection type internal combustion engine, which directly injects fuel into a combustion chamber of the internal combustion engine, has been developed.

The in-cylinder injection type internal combustion engine is configured to perform the injection of fuel using a fuel injection valve directly inside the combustion chamber of a cylinder, promotes burning of the injected fuel by decreasing a particle size of the fuel to be injected from the fuel injection valve, and achieves the reduction of harmful exhaust gas substances, improvement of output of the internal combustion engine, and the like.

Further, high current is caused to flow at the time of opening the fuel injection valve since the high-pressure fuel is injected from the fuel injection valve inside the cylinder in the in-cylinder injection type internal combustion engine. Thus, a fuel control device for an in-cylinder injection type internal combustion engine includes a boost circuit and is configured to cause high current to flow to a fuel injection valve using a generated boost voltage as disclosed in JP 2013-39398 A (PTL 1), for example. In addition, control is executed such that the boost voltage is observed by a boost voltage detection unit, a boosting operation is stopped when the boost voltage reaches a prescribed value, and the boosting operation is started again when the boost voltage decreases by a voltage of a predetermined value or more from the prescribed value in order to generate the appropriate boost voltage using the boost circuit.

CITATION LIST

Patent Literature

PTL 1: JP 2013-036398 A

SUMMARY OF INVENTION

Technical Problem

Meanwhile, the boosting operation of the boost circuit is stopped when a voltage value of the boost voltage observed by the boost voltage detection unit reaches the prescribed voltage value. However, current flows to a boosting capacitor when a switching element for boosting provided in the boost circuit is turned off, and a voltage different from a legitimate boost voltage is additionally detected at this time. Thus, the boost voltage detection unit observes this added boost voltage and erroneously detects that the boost voltage value sometimes reaches the prescribed value. In particular, such a phenomenon is remarkably seen in a low-temperature state in which ambient temperature is low.

In the low-temperature state, an ESR (equivalent series resistance) component of the boosting capacitor, configured using an electrolytic capacitor forming the boost circuit, increases, and this increase of the resistance component causes the extra voltage to be generated by the current flowing into the boosting capacitor when the switching element is turned off. Incidentally, the same description is also applied for the configuration of causing the current to flow to the boosting capacitor when the switching element is turned on. When a detection timing to detect the boost voltage arrives, the extra voltage generated by the ESR component and the legitimate voltage of the boosting capacitor are added, and an incorrect voltage is detected.

When the erroneous detection of the boost voltage occurs in the boost voltage detection unit in this manner, the boosting operation is stopped before reaching the legitimate boost voltage value which has been originally prescribed, and thus, the control is performed to have a voltage value lower than the legitimate boost voltage value. As a result, the opening of the fuel injection valve is performed at the voltage value lower than the legitimate boost voltage value, and thus, the time required to open the fuel injection valve increases. In this manner, the time required to open the fuel injection valve varies depending on a temperature condition, and there is a problem that an injection amount of fuel is not stabilized and fuel consumption deteriorates.

An object of the present invention is to provide a fuel control device for an internal combustion engine that is able to detect a correct boost voltage regardless of a temperature condition, and stabilize a boost voltage value, and is able to inject an accurate amount of fuel from a fuel injection valve.

Solution to Problem

A characteristic of the present invention is that the boost voltage value detected when current is not flowing in a boosting capacitor at least during a boosting operation is taken as a legitimate boost voltage value, and this legitimate boost voltage value is compared with a prescribed boost voltage value to control the boosting operation.

Advantageous Effects of Invention

According to the present invention, it is possible to stabilize the boost voltage at the legitimate boost voltage value regardless of the temperature condition, and it is possible to inject the accurate amount of fuel from the fuel injection valve, thereby improving fuel consumption.

DESCRIPTION OF EMBODIMENTS

Embodiments of the present invention will be described in detail with reference to the accompanying drawings, but the present invention is not limited to the following embodiments, and various modifications and applications that fall within the technological concept of the present invention will be also included in the scope of the present invention.

Before describing the embodiments of the present invention, a description will be given regarding a fuel control system for an in-cylinder injection type internal combustion engine to which the present invention is applied and a configuration of the fuel control device.

Figure 1:
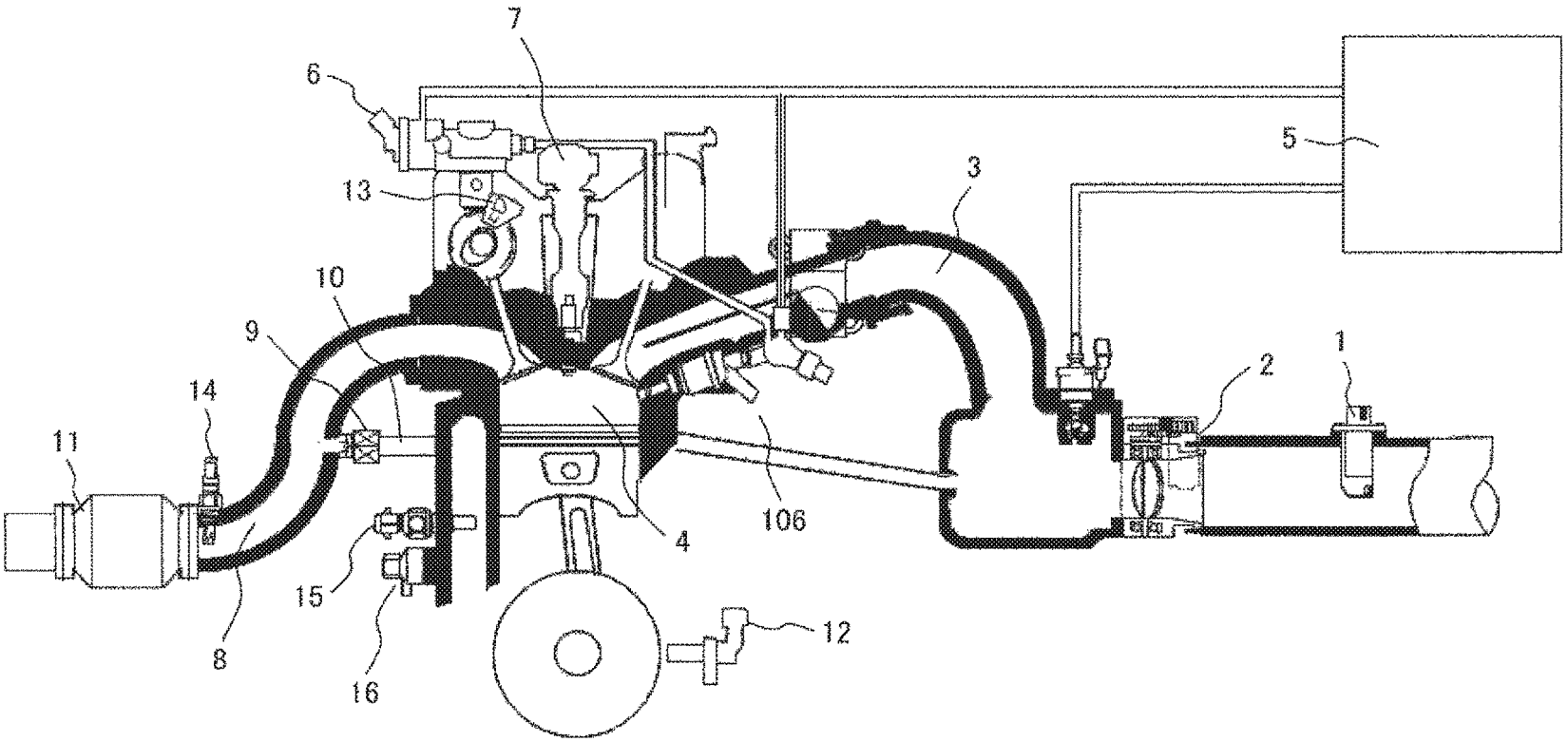
FIG. 1 is a schematic view illustrating an example of a fuel control system for an in-cylinder injection type internal combustion engine.

FIG. 1 is a schematic view illustrating an example of the fuel control system for the in-cylinder injection type internal combustion engine which directly injects fuel inside a cylinder. Intake air passes through an air flow sensor 1, passes through an intake pipe 3 via a throttle valve 2 which controls a flow rate of the intake air, and is introduced into a combustion chamber 4.

Fuel in a fuel tank 5 is pressurized to high pressure by a high-pressure pump 6 and is injected from a fuel injection valve 106 into the combustion chamber 4. The fuel injected into the combustion chamber 4 generates a mixture with the intake air, is ignited by an ignition 7, and is burnt inside the combustion chamber 4.

An exhaust gas after having been burnt in the combustion chamber 4 is discharged to an exhaust pipe 8, and an EGR valve 9 is formed in the middle of the exhaust pipe 8. A part (EGR gas) of the exhaust gas flowing in the exhaust pipe 8 passes through the EGR pipe 10 via the EGR valve 9 and flows back inside the intake pipe 3. A flow rate of the EGR gas is controlled by the EGR valve 9. The exhaust gas discharged to the exhaust pipe 8 is released to the atmosphere after harmful exhaust components thereof are purified by a three-way catalyst 11.

The fuel control system of the in-cylinder injection type internal combustion engine includes known sensors such as a crank angle sensor 12, a cam phase sensor 13, an O2 sensor 14, a temperature sensor 15, and a knock sensor 16, in addition to the air flow sensor 1 described above.

Figure 2:
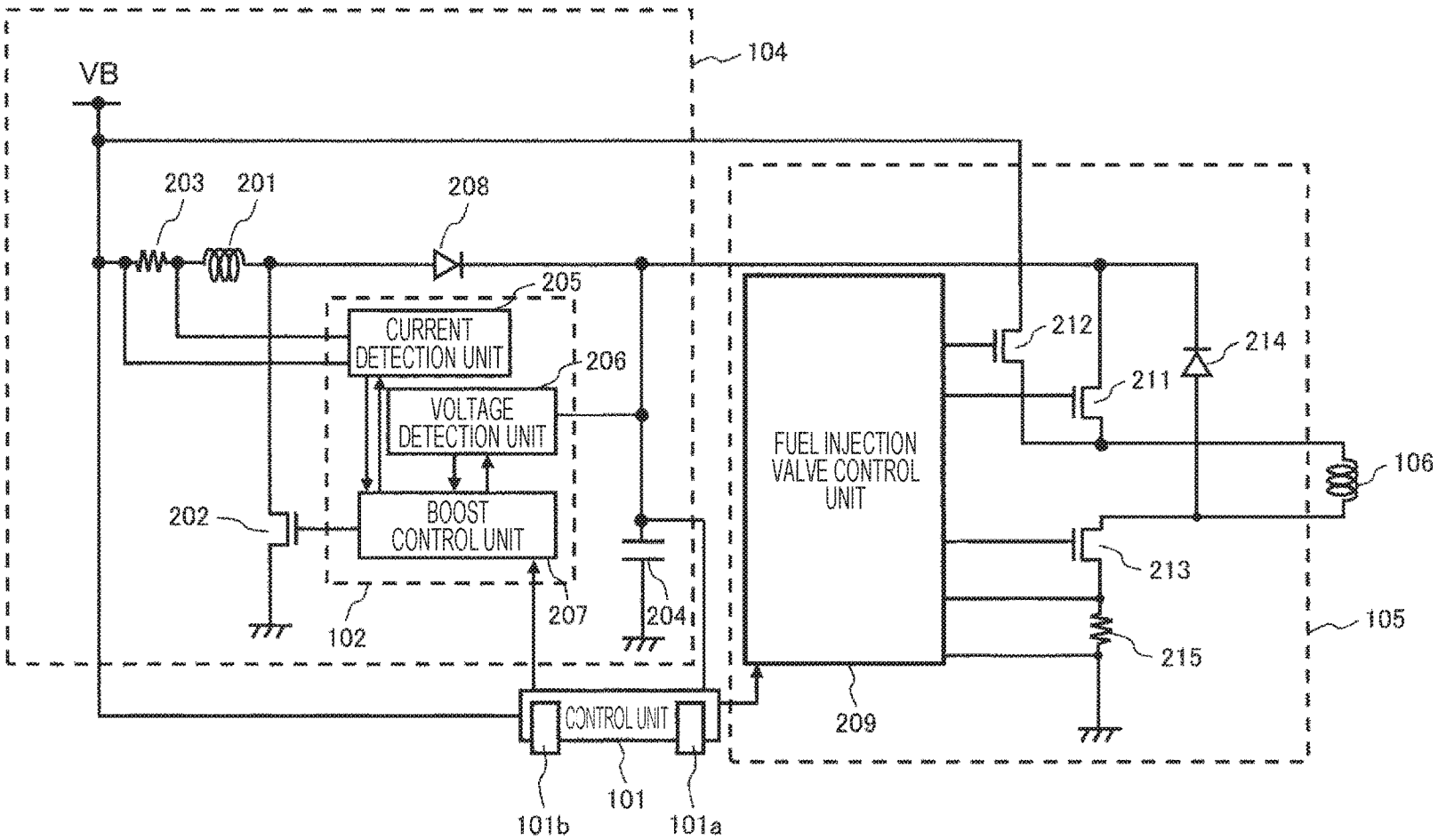
FIG. 2 is a configuration diagram illustrating a configuration of the fuel control device used in the in-cylinder injection type internal combustion engine.

FIG. 2 illustrates the fuel control device for the in-cylinder injection type internal combustion engine. As illustrated in FIG. 2, the fuel control device for the internal combustion engine includes a control unit 101, a boost circuit 104, and a fuel injection valve drive circuit 105.

The control unit 101 is a control unit which controls a boost control unit 207 to be described later of the boost circuit 104 and a fuel injection valve control unit 209 to be described later of the fuel injection valve drive circuit 105 based on an input signal from each of the above-described sensors, and includes peripheral circuits such as a CPU, an ROM, and an RAM (not illustrated). A coefficient, a constant, and the like that are used in a control program and calculation are stored in the ROM, and the CPU executes various control functions according to the control program.

The boost circuit 104 is a circuit which generates a high voltage required to open the fuel injection valve 106 from an in-vehicle DC voltage source, and includes a boost coil 201, a boost switching element 202, a current detection resistor 203, a boosting capacitor 204, a backflow preventing diode 208, and a boost control circuit 102. The in-vehicle DC voltage source is, for example, an in-vehicle battery. Hereinafter, a voltage of the in-vehicle DC voltage source will be referred to as a battery power supply voltage VB. The switching element 202 is, for example, an Nch FET.

The boost coil 201 is a coil configured to generate the high voltage required to open the fuel injection valve 106 from the battery power supply voltage VB. The switching element 202 is an element which performs a switching operation configured to generate the boost voltage, which is the high voltage required to open the fuel injection valve 106, from the battery power supply VB using the boost coil 201, and is, for example, the Nch FET. The current detection resistor 203 is a shunt resistor configured to detect the boost current flowing in the boost coil 201.

The boosting capacitor 204 is an electrolytic capacitor which stores the boost voltage boosted by the boost coil 201. The backflow preventing diode 208 is a diode which prevents backflow of a boost voltage VH stored in the boosting capacitor 204 toward the boost coil 201.

The boost control circuit 102 is a circuit which controls the boosting operation, and includes the boost control unit 207, a boost voltage detection unit 206 (indicated as a voltage detection unit in the drawings), and a current detection unit 205. The boost control unit 207 is a control unit which controls driving of the switching element 202, and includes peripheral circuits such as a CPU, a ROM, and a RAM (not illustrated). The boost control unit 207 controls the boost voltage detection unit 206, and the boost voltage detection unit 206 is a detection unit which detects a charge voltage, that is, the boost voltage VH stored in the boosting capacitor 204. The current detection unit 205 is a detection unit which detects current flowing in the current detection resistor 203, that is, current flowing in the boost coil 201. Details of the boosting operation in the boost control circuit 102 will be described later.

The fuel injection valve drive circuit 105 includes a MOSFET 211 for peak current, a MOSFET 212 for holding current, a MOSFET 213 for a downstream side, a regenerative diode 214, and the fuel injection valve control unit 209. The peak current MOSFET 211 is a switching element configured to cause peak current required to open the fuel injection valve 106 to flow using the boost voltage VH stored in the boosting capacitor 204, and to which the boost voltage VH stored in the boosting capacitor 204 is applied.

The holding current MOSFET 212 is a switching element configured to cause holding current required to hold an open-valve state of the fuel injection valve 106 to flow, and to which the battery power supply voltage VB is applied. The downstream-side MOSFET 213 is an element configured to cause the regenerative diode 214 to regenerate energy, stored in a coil of the fuel injection valve 106, in the boost circuit 104 so as to lower the current flowing in the fuel injection valve 106 in a short time, and is provided between the fuel injection valve 106 and ground. The regenerative diode 214 is a diode which regenerates the energy, stored in the coil of the fuel injection valve 106, in the boost circuit 104 as described above.

The fuel injection valve control unit 209 is a control unit which controls the respective MOSFETs 211 to 213 of the fuel injection valve drive circuit 105, and includes peripheral circuits such as a CPU, a ROM, and a RAM (not illustrated). The control of the fuel injection valve 106 performed by the fuel injection valve drive circuit 105 will be described below together with the boosting operation in the boost control circuit 102.

Figure 3:
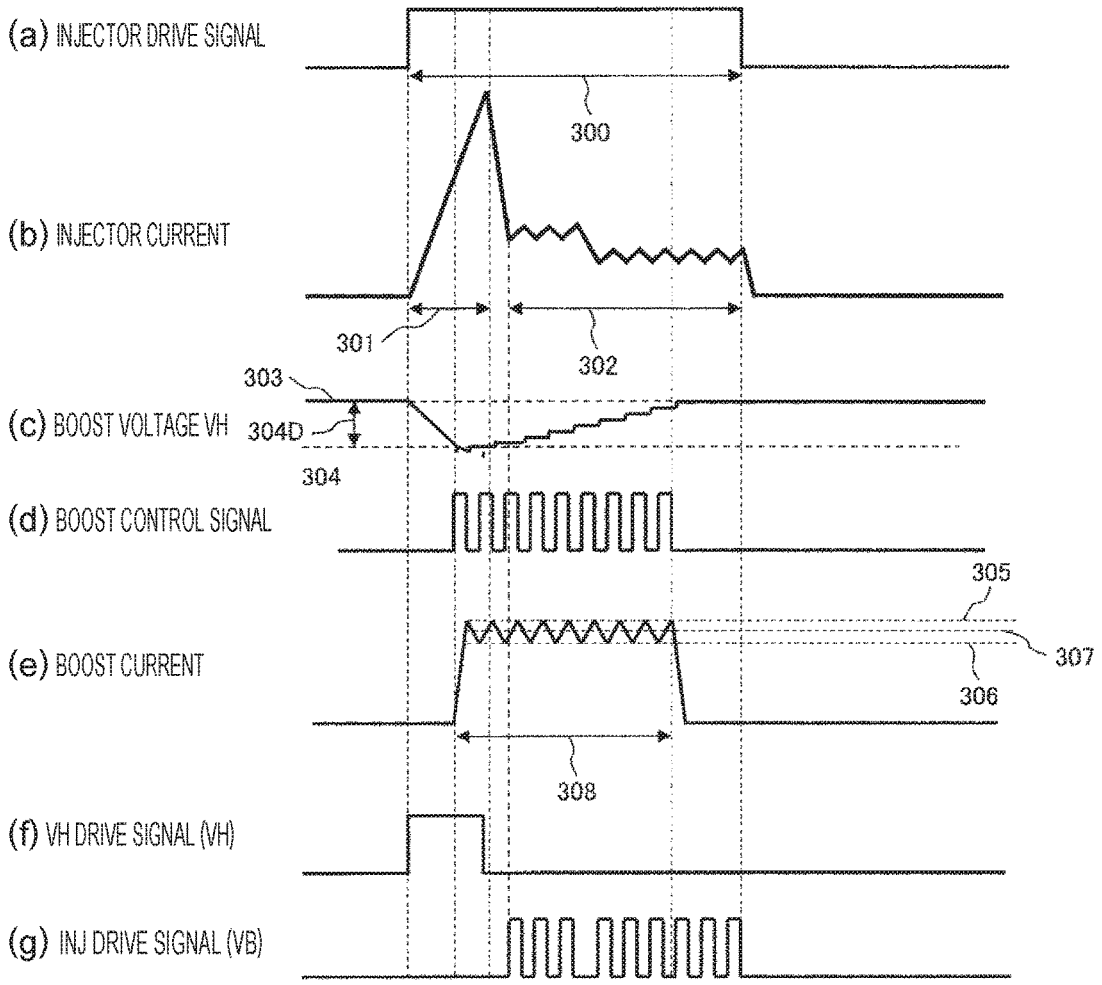
FIGS. 3A-3G are time chart diagrams of each signal relating to driving and a boosting operation of a fuel injection valve.

FIGS. 3(*a*) to 3(*g*) are time charts of each signal relating to driving and the boosting operation of the fuel injection valve 106. FIG. 3(*a*) is the time chart of a fuel injection valve drive signal which is output from the control unit 101 to the fuel injection valve control unit 209. FIG. 3(*b*) is the time chart of a current waveform of current flowing to the fuel injection valve 106. FIG. 3(*c*) is the time chart illustrating the boost voltage VH, that is, a voltage change of the boosting capacitor 204. FIG. 3(*d*) is the time chart of a boost control signal which is output from the boost control unit 207 to control switching of on and off of the switching element 202. FIG. 3(*e*) is the time chart of the boost current flowing in the boost coil 201. FIG. 3(*f*) is the time chart of a VH drive signal which is output from the fuel injection valve control unit 209 to control switching of on and off of the peak current MOSFET 211. FIG. 3(*g*) is the time chart of an INJ drive signal which is output from the fuel injection valve control unit 209 to control switching of on and off of the holding current MOSFET 212.

Next, the drive control of the fuel injection valve 106 will be described. As illustrated in FIG. 3(*a*), the control unit 101 outputs a Hi-signal of the fuel injection valve drive signal to the fuel injection valve control unit 209 during a period 300. When the Hi-signal of the fuel injection valve drive signal from the control unit 101 is input to the fuel injection valve control unit 209, the fuel injection valve control unit 209 controls the fuel injection valve drive circuit 105 such that the fuel injection valve 106 is conducted during the period 300 in which the Hi-signal of the fuel injection valve drive signal is output. Further, when a Lo-signal of the fuel injection valve drive signal from the control unit 101 is input to the fuel injection valve control unit 209, the fuel injection valve control unit 209 controls the fuel injection valve drive circuit 105 so as to end the conduction to the fuel injection valve 106.

That is, the fuel injection valve control unit 209 first outputs a Hi-signal of the VH drive signal to the peak current MOSFET 211 when the Hi-signal of the fuel injection valve drive signal from the control unit 101 is input thereto as illustrated in FIG. 3(*f*). Accordingly, the high voltage of the boosting capacitor 204 is applied to the fuel injection valve 106 via the peak current MOSFET 211, and a high drive current of the fuel injection valve flows as in a waveform during a period 301 illustrated in FIG. 3(*b*). The fuel injection valve 106 is rapidly opened by this high drive current of the fuel injection valve.

The fuel injection valve control unit 209 outputs the Hi-signal of the VH drive signal to the peak current MOSFET 211 for a period sufficient for opening of the fuel injection valve 106, that is, during the period 301, and then, outputs a Lo-signal of the VH drive signal to the peak current MOSFET 211. Accordingly, the high voltage of the boosting capacitor 204 which has been applied via the peak current MOSFET 211 is cut off.

Thereafter, the fuel injection valve control unit 209 repeatedly outputs a Hi-signal and a Lo-signal of the INJ drive signal to the holding current MOSFET 212 until the period 300 ends, that is, during a period 302 in FIG. 3(*b*). Accordingly, the battery power supply voltage VB is applied to the fuel injection valve 106 via the holding current MOSFET 212, and a fuel injection valve current required to hold the open-valve state of the fuel injection valve 106 flows as in a waveform during the period 302. The open-valve state of the fuel injection valve 106 is held by this fuel injection valve current.

Thereafter, the fuel injection valve control unit 209 outputs the Lo-signal of the INJ drive signal to the holding current MOSFET 212 when the period 300 ends, that is, the period 302 ends. Accordingly, the battery power supply voltage VB which has been applied via the holding current MOSFET 212 is cut off. Incidentally, the period 302 is set depending on a magnetic circuit characteristic of the fuel injection valve 106, pressure of fuel supplied to the fuel injection valve 106, and a current conduction period of the fuel injection valve in response to a fuel amount required for an engine.

Next, the boost control will be described. When the boost voltage VH of the boosting capacitor 204 is applied to the fuel injection valve 106 via the peak current MOSFET 211 in a state where the boost voltage VH of the boosting capacitor 204 reaches a voltage indicated by a reference sign 303 in FIG. 3(*c*), the boost voltage VH starts to decrease as illustrated in FIG. 3(*c*). In the following description, a voltage value indicated by the reference sign 303 will be referred to as a boosting stop voltage value.

When the boost voltage VH of the boosting capacitor 204 detected by the boost voltage detection unit 206 decreases due to the conduction to the fuel injection valve 106 and the boost control unit 207 determines that a differential voltage value from the boosting stop voltage value 303 is a predetermined differential voltage value 304D or more, the boost control unit 207 starts the boosting operation to be described as follow. That is, the boost control unit 207 outputs the boost control signal to control switching of on and off of the switching element 202 to the switching element 202 as illustrated in FIG. 3(*d*). In the following description, a voltage value 304 decreased from the boosting stop voltage value 303 by the predetermined differential voltage value 304D will be referred to as a boosting start voltage value.

When an on-signal of the boost control signal is output from the boost control unit 207, the switching element 202 is turned on, current flows to the boost coil 201, and the boost current rises as illustrated in FIG. 3(*e*). When the boost current detected by the current detection unit 205 reaches an upper threshold 305, the boost control unit 207 outputs an off-signal of the boost control signal to the switching element 202. Accordingly, the switching element 202 is turned off. The energy stored in the boost coil 201 during a period in which the switching element 202 is turned off flows into and is stored in the boosting capacitor 204 as current, whereby the boost voltage VH slightly increases.

The boost current decreases during the period in which the switching element 202 is turned off. Further, when the boost current detected by the current detection unit 205 reaches a lower threshold 306, the boost control unit 207 outputs the on-signal of the boost control signal to the switching element 202, again. Through such repetition, the energy is stored in the boosting capacitor 204 and the boost voltage VH increases. Incidentally, an average value between the upper threshold 305 and the lower threshold 306 of the boost current will be referred to as an average boost current value 307, and a time 308, which is necessary for the boost voltage that has decreased due to the conduction to the fuel injection valve 106 to return to the boosting stop voltage value 303 as an initial voltage value, will be referred to as a boost voltage recovery time.

When a series of the switching operations of the switching element 202 described above is repeated, the boost voltage VH is gradually recovered up to the boosting stop voltage value 303 as illustrated in FIG. 3(*c*). When the boost control unit 207 determines that the voltage of the boosting capacitor 204 detected by the boost voltage detection unit 206 is the boosting stop voltage value 303 of higher, the boost control unit 207 ends the boosting operation.

Figure 4:
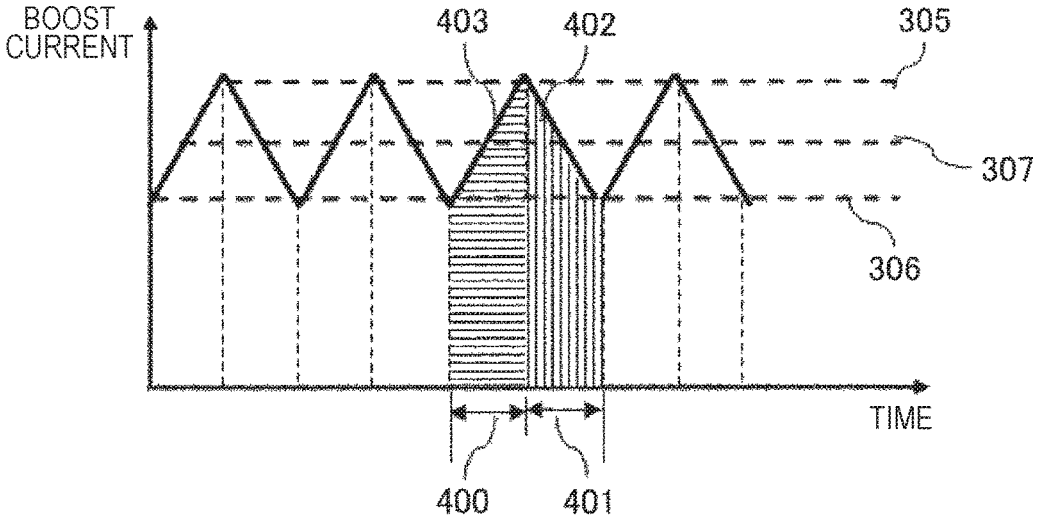
FIG. 4 is a waveform diagram illustrating an enlarged waveform of a boost current during a boosting operation.

FIG. 4 illustrates an enlarged waveform of the boost current during the boosting operation. A boost current 403 flowing to the boost coil 201 increases during an on-period 400 in which the switching element 202 is turned on. When the boost current reaches the upper threshold 305, the switching element 202 is turned off as described above, and a boost current 402 decreases during an off-period 401 until the boost current reaches the lower threshold 306.

When an inductance of the boost coil 201 is denoted by L and a voltage value of the battery power supply voltage VB is denoted by V, an inclination of the boost current during the on-period 400 in which the boost current is increased up to the upper threshold 305 is proportional to V/L. Thus, the on-period 400 becomes shorter as the battery power supply voltage VB increases, and the boost voltage recovery time 308 also becomes shorter. On the contrary, the on-period 400 becomes longer as the battery power supply voltage VB decreases, and the boost voltage recovery time 308 also becomes longer. Accordingly, it is necessary to recover the boost voltage VH, which has decreased due to the conduction to the fuel injection valve 106, up to the boosting stop voltage value 303 until the next fuel injection is started in the fuel injection valve 106, in the fuel control system for the in-cylinder injection type internal combustion engine.

Conventionally, it is configured such that a voltage value of the boost voltage VH is constantly detected by the boost voltage detection unit 206 at a predetermined detection timing at the time of performing a boosting operation, and the boosting operation is stopped when the detected boost voltage value increases up to a reference value set in advance, for example, when the boost voltage VH increases up to the above-described boosting stop voltage value 303. Further, it is configured such that the boosting operation is started again when the detected voltage value of the boost voltage VH decreases from the boosting stop voltage value 303 to the predetermined voltage value 304D or more.

However, current flows to the boosting capacitor 204 when the switching element 202 provided in the boost circuit 104 is turned off, and a voltage different from the legitimate boost voltage VH is sometimes additionally detected at this time in the above-described method of constantly detecting the boost voltage VH at predetermined successive detection timings. In a low-temperature state, an ESR (equivalent series resistance) component of the boosting capacitor, configured using an electrolytic capacitor forming the boost circuit, increases, and this increase of the resistance component causes the extra voltage to be generated by the current flowing in the boosting capacitor when the switching element is turned off. When a detection timing to detect the boost voltage VH arrives, the extra voltage generated by the ESR component and the legitimate boost voltage VH of the boosting capacitor are added, and an incorrect voltage is detected.

Figure 5:
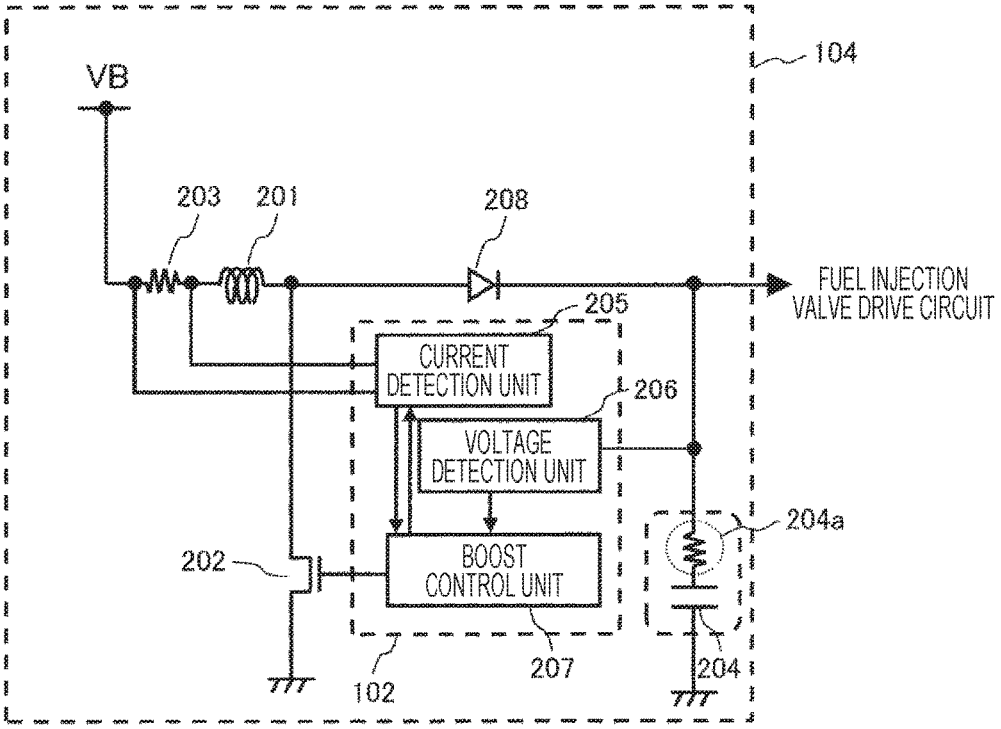
FIG. 5 is a circuit diagram displaying an ESR component in a boost circuit.

FIG. 5 illustrates the boost circuit in the low-temperature state. Since the ESR component of the boosting capacitor 204 increases in the low-temperature state, a resistance 204*a* is equivalently added on the basis of the ESR component of the boosting capacitor 204. During the boosting operation, the current flows to the boosting capacitor 204 in the period in which the switching element 202 is turned off, and an boost voltage value VHc upon appearance and detected by the boost voltage detection unit 206 is obtained by adding a legitimate voltage value VHa of the boosting capacitor 204 and an extra error voltage value obtained by multiplying a resistance value Rc of the resistance 204*a* based on the ESR component and a current value Ic flowing to the boosting capacitor 204. That is, VHc=VHa+Rc·Ic is established, and a voltage value obtained by Rc·Ic becomes an error.

Figure 6:
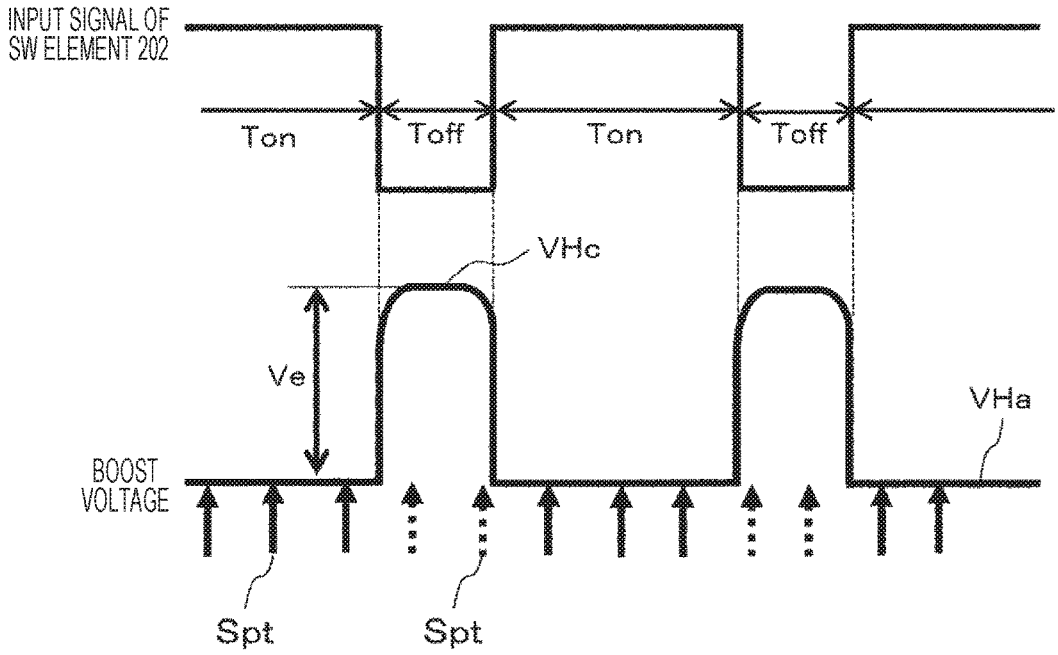
FIG. 6 is an explanatory diagram illustrating an input signal to a boost switching element, a boost voltage, and a detection timing at the time of low temperature in the related art.

FIG. 6 illustrates behaviors of the input signal to the switching element 202 and the boost voltage during the boosting operation. The current flows into the boosting capacitor 204 during a period Toff in which the input signal to the switching element 202 is the off-signal, and thus, an extra error voltage Ve, caused by the resistance 204*a* based on the ESR component of the boosting capacitor 204 described above, is generated and added to the voltage value VHa of the boost voltage VH. On the contrary, the current does not flow into the boosting capacitor 204 during a period Ton in which the input signal to the switching element 202 is the on-signal, and thus, the error voltage Ve, caused by the resistance 204*a* based on the ESR component of the boosting capacitor 204, is not generated, and the legitimate boost voltage value VHa is obtained.

Thus, the legitimate boost voltage VHa can be detected at a detection timing Spt indicated by a solid arrow, and the error voltage value Ve is present at a detection timing Spt indicated by a broken arrow. Thus, the incorrect boost voltage value VHc which is set by VHa+Ve is detected.

First Embodiment

Next, a first embodiment of the present invention will be described. As described above, the current flows into the boosting capacitor 204 during the period Toff in which the input signal to the switching element 202 is the off-signal, and thus, an extra error voltage Ve, caused by the resistance 204*a* based on the ESR component of the boosting capacitor 204, is generated and added to the voltage value VHa of the boost voltage VH. Thus, the incorrect boost voltage value VHc set by VHa+Ve is detected when the detection timing Spt arrives during the period Toff.

Figure 7:
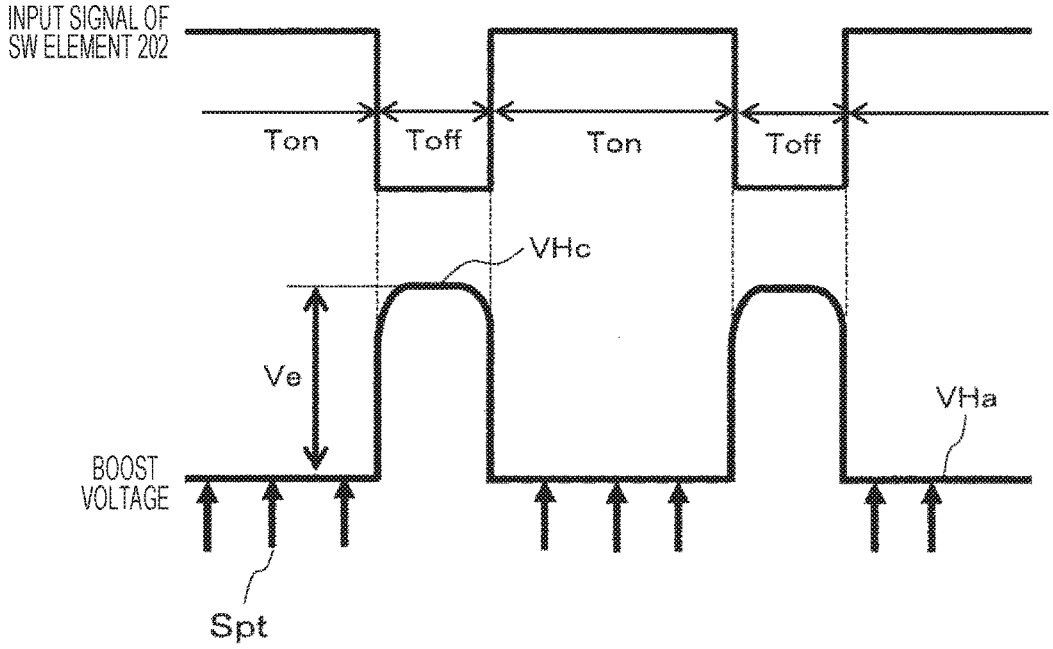
FIG. 7 is an explanatory diagram illustrating an input signal to a boost switching element, a boost voltage, and a detection timing at the time of low temperature according to a first embodiment of the present invention.

Therefore, it is configured such that the boost voltage VH is detected by the boost voltage detection unit 206 by setting a detection timing only in the period Ton in which an input signal to the switching element 202 is the on-signal at least during the boosting operation, as illustrated in FIG. 7, in the present embodiment. Since the current does not flow into the boosting capacitor 204 during the period Ton in which the input signal to the switching element 202 is the on-signal, it is possible to detect the legitimate boost voltage value VHa of the boosting capacitor 204 without considering the error voltage value Ve generated due to the influence of the resistance 204*a* based on the ESR component of the boosting capacitor.

A basic idea of the present embodiment is given as follows. In the present embodiment, detection of a boost voltage is constantly performed by the boost voltage detection unit 206 at the predetermined successive detection timings Spt in a state where the boosting operation has not been executed. Further, a method of detecting the boost voltage is changed, for example, when the boost voltage detection unit 206 detects that the fuel injection valve is driven and the boost voltage decreases to a reference value or lower, and the boosting operation is started. At the time of executing the boosting operation, the boost voltage detection unit 206 performs detection of the legitimate boost voltage value VHa based on a boost voltage detection timing signal from the boosting operation control unit 207 only during the period Ton in which the input signal to the switching element 202 is the on-signal. On the contrary, the detection of the boost voltage VHc including the error voltage value Ve is not performed during the period Toff in which the input signal to the switching element 202 is the off-signal since the boost voltage detection unit 206 ignores the boost voltage detection timing signal from the boosting operation control unit 207 or the boosting operation control unit 207 stops the detection timing signal.

Incidentally, the boost circuit 104 generally performs the boosting operation when the fuel injection valve 106 is driven. However, the voltage stored in the boosting capacitor 204 sometimes decreases due to discharging even when the fuel injection valve 106 is not driven. Thus, the boost circuit 104 is configured to start the boosting operation when the boost voltage VH of the boosting capacitor 204 decreases to the predetermined value 304D or more, and accordingly, the same operation as described in the above-described case is performed even at a detection timing of the boost voltage VH at this time.

Hereinafter, a specific control flow of the present embodiment will be described. First, the entire control flow will be described in FIG. 8. The following control flow is a control function which is executed mainly using the boost control unit 207 and the boost voltage detection unit 206.

<<Step S10>>

A control state of the fuel control device is detected in step S10. This detection of the control state is configured to detect current driving and control states of the fuel injection valve drive circuit 209, the boost circuit 104, and the like. In addition, a temperature detection means such as a thermistor is provided in a control box in which the fuel injection valve drive circuit 209, the boost circuit 104, and the like are housed, and ambient temperature of the fuel injection valve drive circuit 209, the boost circuit 104, or the like is detected by the temperature detection means in the present embodiment. Incidentally, when the temperature detection means is not provided in the control box, it is possible to use a temperature detection means such as a water temperature sensor provided in the internal combustion engine, instead.

Although not illustrated, operating information of the internal combustion engine is detected in addition to the above-described information, and typically, key switch information, rotational speed information, temperature information, air flow rate information, load information, and the like are detected. Further, there is no problem in detecting information other than the above-described information if necessary. Further, the process is shifted to step S11 when detecting such state information.

<<Step S11>>

Next, the current driving and control states of the boost circuit 104 are determined, and whether it is the state where the boosting operation is performed is determined in step S11. For this determination, a boosting operation drive flag is checked, and the boosting operation drive flag is controlled by the control unit 101. The control unit 101 monitors the boost voltage VH of the boosting capacitor 204, and thus, determines that it is necessary to perform boosting when the boost voltage VH decreases to a predetermined voltage value or lower and controls the boosting operation drive flag to "1". Accordingly, this step S11 is shifted to step S12 when it is determined that the boosting operation drive flag is "1" or shifted to end when it is determined that the boosting operation drive flag is not "1". Then, this control flow process is ended, and the device waits for the next startup timing.

Incidentally it is also possible to omit this step S11 in the case of executing a control step to be described later even when the boosting operation is not performed.

<<Step S12>>

In step S12, whether the current temperature of the control box is a predetermined value or higher is determined. In fact, measurement of temperature of the boosting capacitor 204 is favorable, but the temperature of the control box is detected in the present embodiment. In this determination, whether a resistance caused by the ESR component is generated in the boosting capacitor 204 is determined. The process is shifted to step S13 when it is determined that the temperature is the predetermined value or lower, or shifted to step S14 when it is determined that the temperature is the predetermined value or higher. Accordingly, the process is shifted to step S13 in the state where the temperature of the control box is the predetermined value or lower, and is switched to step S14 when the temperature increases. Incidentally, it is also possible to estimate temperature of the boost circuit 104 from water temperature information of the internal combustion engine, and then, the determination in step S12 is performed using this water temperature information. In this manner, it may be enough to determine whether the ESR component due to the temperature is generated in the boosting capacitor 204 in this step S12, and a detection position of temperature or a detection means is arbitrary.

<<Step S13>>

When it is determined in step S12 that the temperature is the predetermined value or lower, an intermittent measurement mode is executed in step S13. In this intermittent measurement mode, the boost voltage is detected by the boost voltage detection unit 206 by setting a detection timing only during the period Ton in which the input signal to the switching element 202 is the on-signal such as the detection timing illustrated in FIG. 7. Thus, it is possible to detect the legitimate boost voltage value VHa of the boosting capacitor 204 without considering the error voltage Ve generated due to the influence of the resistance 204*a* based on the ESR component of the boosting capacitor since the current does not flow into the boosting capacitor 204 during the period Ton in which the input signal to the switching element 202 is the on-signal. Details of the intermittent measurement mode will be described on the basis of FIG. 9.

<<Step S14>>

When it is determined in step S12 that the temperature is the predetermined value or higher, a constant measurement mode is executed in step S14. In this constant measurement mode, the boost voltage VH of the boosting capacitor 204 is constantly detected at successive detection timings regardless of on and off states of the input signal to the switching element 202 such as the detection timing illustrated in FIG. 6. When the temperature is the predetermined value or higher, the resistance based on the ESR component is not generated or is very slight even if generated, and thus, a value of the error voltage Ve is low. Thus, the problem caused by the ESR component as in the low-temperature state does not occur even if the boost voltage VH is constantly detected. This constant measurement mode in this step S14 is a measurement mode which has been conventionally conducted, and thus, will not be described any more.

Figure 9:
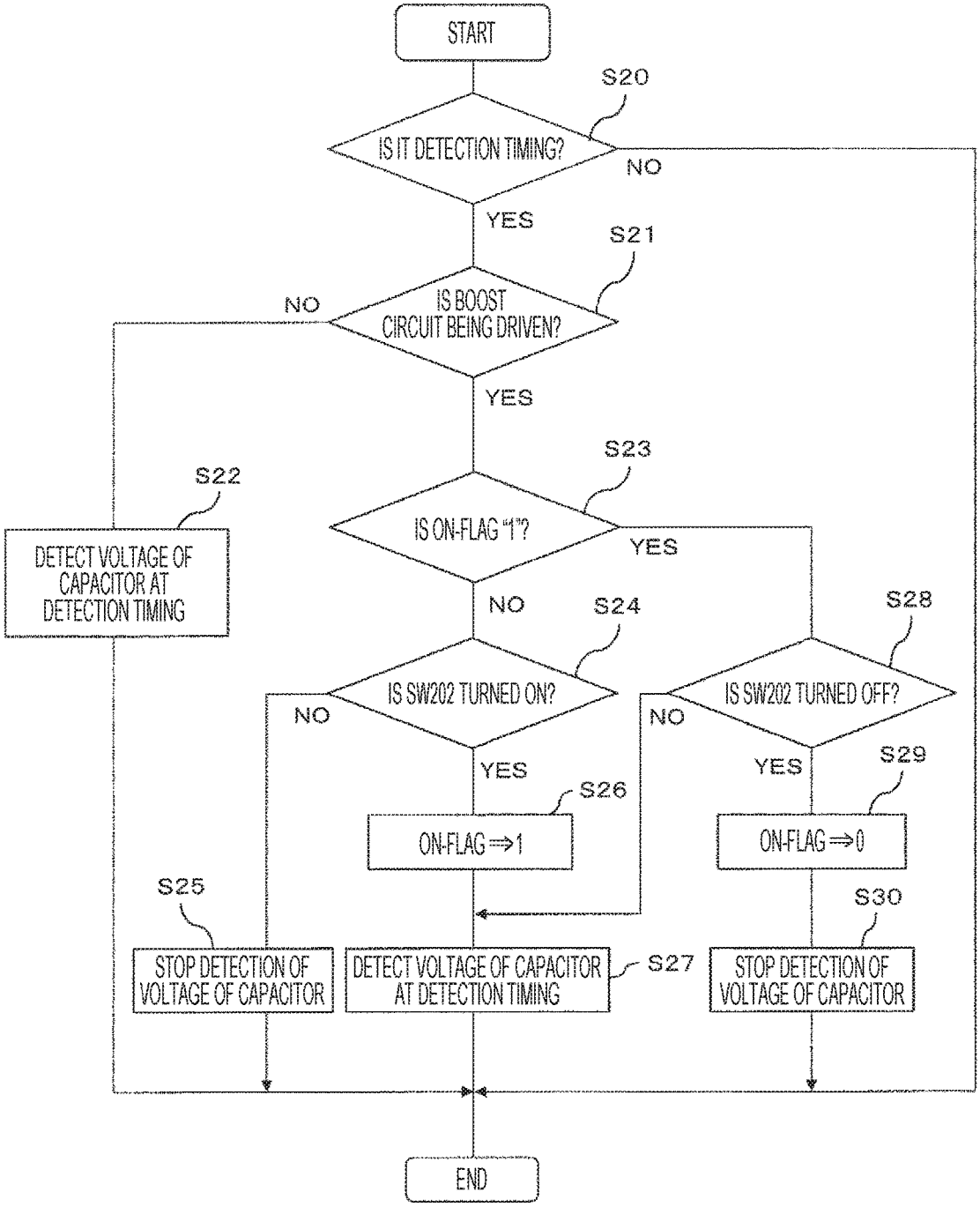
FIG. 9 is a control flow chart diagram illustrating details of an intermittent measurement mode illustrated in FIG. 8.

Next, the intermittent measurement mode in step S13 will be described in detail with reference to FIG. 9.

<<Step S20>>

When it is determined in step S12 that the temperature is the predetermined value or lower, it is determined that the resistance caused by the ESR component is generated in the boosting capacitor 204, and the control flow of step S20 and the subsequent steps is executed. In this step S20, whether the detection timing Spt has arrived is determined during the boosting operation as illustrated in FIG. 7. When the detection timing Spt does not arrive during the boosting operation, the process is shifted to the end, and the control flow is ended. On the contrary, the process is shifted to step S21 when it is determined that the detection timing Spt has arrived.

<<Step S21>>

In step S21, whether the boost circuit 105 has been driven so that the boosting operation has been executed is determined. The process is shifted to step S22 when it is determined that the boosting operation has not been executed in this step S21, or is shifted to step S23 when it is determined that the boosting operation has been executed. Incidentally, it is possible to perform this determination on the boosting operation in this step S21 using various methods.

For example, it is possible to perform this determination based on whether the fuel injection valve 106 has been driven. The process is shifted to step S22 when it is determined that the fuel injection valve 106 has not been opened and the boost circuit 104 has not been driven, or is shifted to step S23 when it is determined that the fuel injection valve 106 has been opened and the boost circuit 104 has been driven. Since the high voltage is applied from the boosting capacitor 204 to the fuel injection valve 106 when the fuel injection valve 106 is driven, the boost voltage of the boosting capacitor 204 decreases with time. Thus, the start of the boosting operation is detected by determining a decrease of the boost voltage of the boosting capacitor 204 to a reference value or lower from a drive state of the fuel injection valve 106. Incidentally, it is also possible to perform the above-described determination by monitoring the boosting operation from a change state of the boost voltage VH of the boosting capacitor 204 instead of the drive state of the fuel injection valve 106.

In addition, the voltage stored in the boosting capacitor 204 sometimes decreases due to discharging even when the fuel injection valve 106 is not driven. Thus, the boost circuit 104 is configured to start the boosting operation when the boost voltage of the boosting capacitor 204 decreases to the reference value or lower. Accordingly, it is possible to perform the above-described determination by detecting that the boost circuit 104 has been driven. Accordingly, the main point in this step S21 is that it is enough if it is possible to determine whether a boost drive circuit 104 is performing the boosting operation at the current point in time.

<<Step S22>>

When it is determined in step S21 that the boost circuit 104 has not performed the boosting operation, this step S22 is executed. In this step S22, the boost voltage of the boosting capacitor 204 is detected at a normal detection timing Spt. This detection timing is the same as the detection timing in the constant measurement mode. In this case, it is possible to detect the legitimate boost voltage value VHa since the current does not flow to the boosting capacitor 204. The process is shifted to the end when the detection of the boost voltage VH is ended, and this control flow is ended. Further, the device waits for arrival of a next startup timing, again.

<<Step S23>>

When the detection timing Spt arrives in step S20 and it is determined in step S21 that the boost circuit 104 is in the middle of the boosting operation, whether an on-flag to be described later is "1" is determined in step S23. For this on-flag, "1" is set when the switching element 202 (indicated as SW202 in FIG. 8) is turned on in step S26 to be described later. When the on-flag is continuously in the state of "1", this indicates that the switching element 202 is turned on and the current is not supplied to the boosting capacitor 204. When the on-flag is continuously in the state of "0", this indicates that the switching element 202 is turned off and the current is supplied to the boosting capacitor 204. The process is shifted to step S24 when it is determined in this step S23 that the on-flag is not "1", or is shifted to step S28 when it is determined that the on-flag is "1".

<<Step S24>>

When it is determined in step S23 that the on-flag is not "1", this indicates that the switching element 202 is in an off-state. Therefore, whether the switching element 202 has been switched from the off-state to an on-state is determined in this step S24. The switching element 202 maintains the off-state unless being turned on in this step S24. In this case, a state where the current flows to the boosting capacitor 204 is formed. On the contrary, when the switching element 202 is turned on in step S24, the above-described state is switched to a state where the current does not flow to the boosting capacitor 204. This state is a state where the input signal of the switching element 202 in FIG. 7 is switched from the off signal to the on-signal.

<<Step S25>>

When it is determined in step S24 that the switching element 202 is in the off-state without being turned on, the detection of the boost voltage VH of the boosting capacitor 204 is stopped in step S25. That is, the detection of the boost voltage is not executed even if the detection timing Spt arrives. This corresponds to the off-period Toff of the switching element 202 in FIG. 7, and the detection of the boost voltage VH at the detection timing Spt is not executed. Accordingly, there is no case of detecting the boost voltage value VHc including the error voltage value Ve. The process is shifted to the end when the processing in step S25 is ended, and this control flow is ended. Further, the device waits for arrival of a next startup timing, again.

<<Step S26>>

When it is determined in step S24 that the switching element 202 has been turned on, the on-flag is set to "1" in step S26. Accordingly, it is indicated that the switching element 202 is turned on and the current does not flow to the boosting capacitor 204 at the current point in time. This information of the on-flag is used in step S23 so that it is possible to determine the state of the switching element 202.

<<Step S27>>

When the setting of the on-flag is completed in step S26, the error voltage Ve caused by the ESR component is not generated since the current does not flow to the boosting capacitor 204 in this state. This corresponds to the on-period Ton of the switching element 202 in FIG. 7, and the detection of the boost voltage value VHa is executed at the detection timing Spt. Accordingly, it is possible to detect the legitimate boost voltage value VHa which does not include the error voltage value Ve. The process is shifted to the end when the processing in step S27 is ended, and this control flow is ended. Further, the device waits for arrival of a next startup timing, again.

<<Step S28>>

Returning to step S23, the process is shifted to step S28 when it is determined in this step S23 that the on-flag is "1". Since the on-flag is "1" in this step, the state where the current does not flow to the boosting capacitor 204 is formed.

Further, whether the switching element 202 has been switched from the on-state to the off-state is determined in this step S28. The switching element 202 maintains the on-state unless being turned off in this step S28. In this case, the state where the current does not flow to the boosting capacitor 204 is formed. On the contrary, when the switching element 202 is turned on in step S28, the above-described state is switched to the state where the current flows to the boosting capacitor 204. This state is a state where the input signal of the switching element 202 in FIG. 7 is switched from the on-signal to the off-signal. The process is shifted to step S27 when it is determined in step S28 that the switching element 202 is not turned off, or is shifted to step S29 when it is determined that the switching element 202 has been turned on.

When it is determined in step S28 that the switching element 202 is not turned off, that is, in the on-state, the detection of the boost voltage VH of the boosting capacitor 204 is continued returning to step S27, again. This corresponds to the on-period Ton of the switching element 202 in FIG. 7, and the detection of the boost voltage value VHa is executed at the detection timing Spt. Accordingly, it is possible to detect the legitimate boost voltage value VHa which does not include the error voltage value Ve. The process is shifted to the end when the processing in step S27 is ended, and this control flow is ended. Further, the device waits for arrival of a next startup timing, again.

<<Step S29>>

When it is determined in step S28 that the switching element 202 has been turned off, the on-flag is set to "0" in step S29. Accordingly, it is indicated that the switching element 202 is turned off and the current flows to the boosting capacitor 204 at the current point in time. This information of the on-flag is used again in step S23, and the process is shifted to step S24 in this case since the on-flag is "0" so that the same operation is continued.

<<Step S30>>

When the setting of the on-flag is completed in step S29, the detection of the boost voltage of the boosting capacitor 204 is stopped in step S30. Since the current flows to the boosting capacitor 204 in this state, the error voltage Ve caused by the ESR component is generated. When it is determined in step S28 that the switching element 202 has been turned off, the detection of the boost voltage VH of the boosting capacitor 204 is stopped in step S30. That is, the detection of the boost voltage is not executed even if the detection timing Spt arrives. This corresponds to the off-period Toff of the switching element 202 in FIG. 7, and the detection of the boost voltage VH at the detection timing Spt is not executed. Accordingly, there is no case of detecting the boost voltage value VHc including the error voltage value Ve. The process is shifted to the end when the processing in step S30 is ended, and this control flow is ended. Further, the device waits for arrival of a next startup timing, again.

Although not illustrated in this control flow, it is configured such that the boosting operation is stopped and the mode is switched to the constant measurement mode in which the detection of the boost voltage is constantly performed if the boost voltage detection unit 206 detects an increase of the boost voltage VH up to a reference value during the period in which the switching element 202 is driven.

In addition, the switching element 202 has been set as the Nch FET in the present embodiment. However, the switching element 202 may be set as a Pch FET to have a configuration in which a boost voltage is detected by the boost voltage detection unit 206 when the switching element 202 is turned off.

Although the description regarding the control flow according to the present embodiment is ended as above, it is possible to implement technical improvement to be described later in addition to the embodiment.

A voltage of a switching input signal of the switching element 202 tends to change with a constant inclination at the time of switching the on and off without an instant change in voltage. Thus, it is desirable to detect the boost voltage VH after the voltage of the switching input signal is completely switched after turning the input signal to the switching element 202 to the on-signal. Accordingly, it is preferable to detect the boost voltage VH after lapse of a certain standby time after turning the input signal into the on-signal. This case can be implemented by providing a time lapse determination processing logic after step S24 and causing the process to be shifted to step S27 when it is determined that a predetermined time has elapsed after the switching element 202 is turned on.

Figure 8:
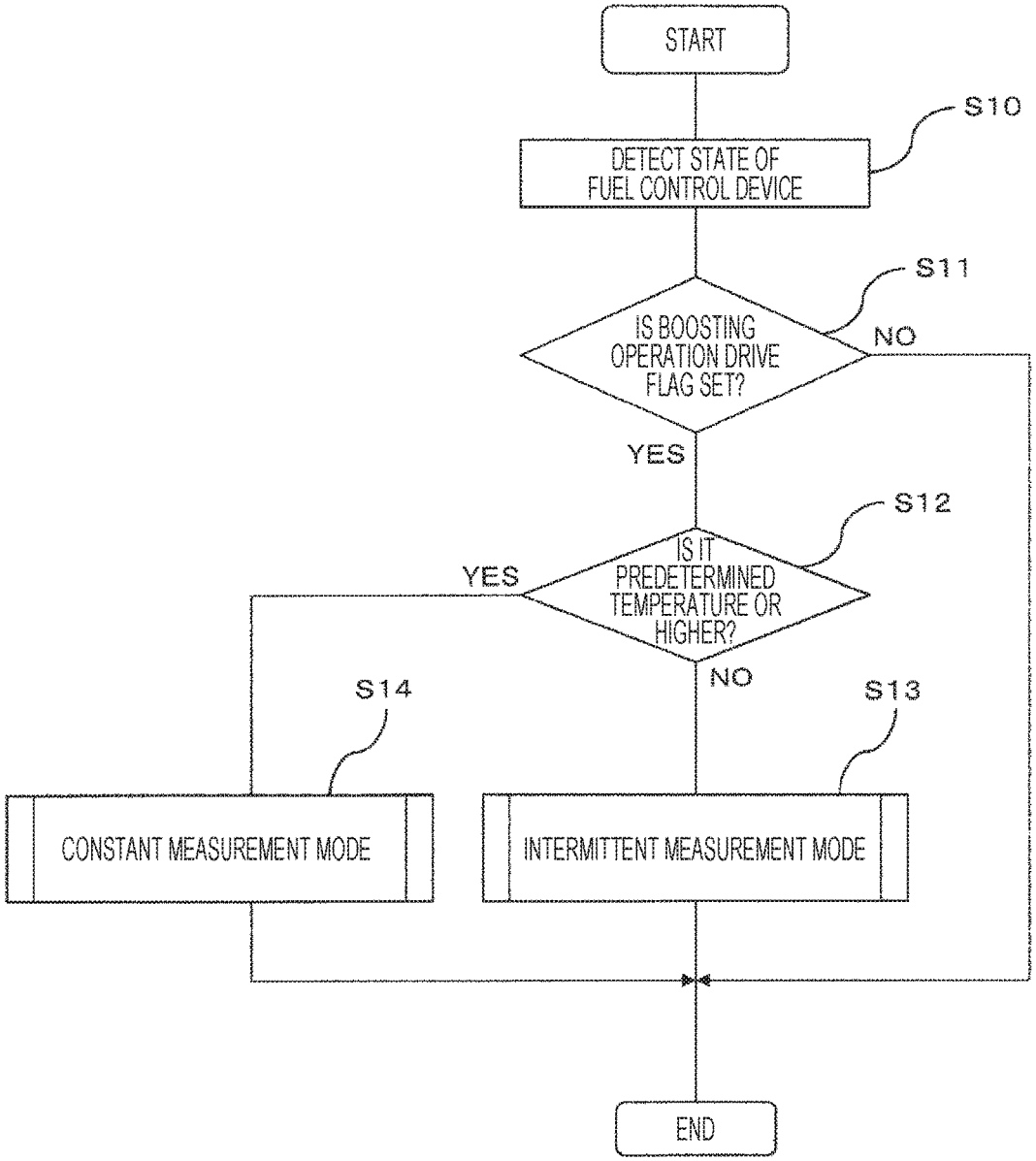
FIG. 8 is a control flow chart diagram for detection of the boost voltage according to the first embodiment of the present invention.

In addition, whether to execute the intermittent measurement mode or the constant measurement mode is selected based on the temperature condition in the above-described embodiment. However, it may be configured such that not the constant measurement mode but the intermittent measurement mode is executed when there is the influence of the ESR component regardless of the temperature condition. In this case, step S12 and step S14 of FIG. 8 are omitted, and step S13 is executed after step S11.

As described above, it is possible to stabilize the boost voltage at the legitimate boost voltage value regardless of the temperature condition, and it is possible to inject an accurate amount of fuel from the fuel injection valve, thereby improving fuel consumption according to the present embodiment.

Second Embodiment

Next, a second embodiment of the present invention will be described. The first embodiment has a characteristic that the detection timing is not set during the period in which the current flows into the boosting capacitor 204. Meanwhile, the second embodiment has a characteristic that a boost voltage value detected during a period in which current does not flow into the boosting capacitor 204 is validated without using a boost voltage value detected during a period in which current flows to the boosting capacitor 204 although successive normal detection timings are set as the detection timing.

Figure 10:
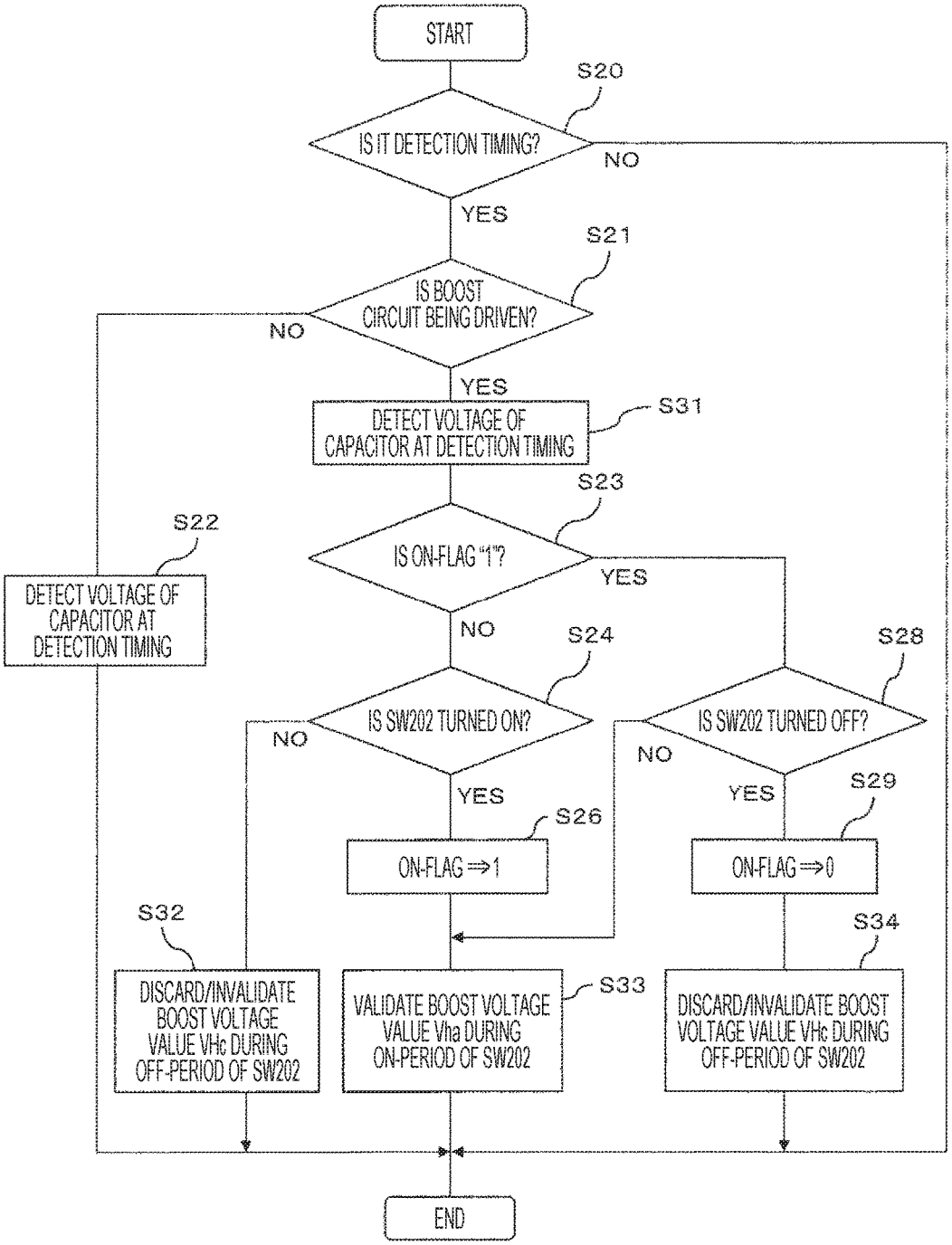
FIG. 10 is a control flow chart diagram for detection of a boost voltage according to a second embodiment of the present invention.

Hereinafter, the second embodiment of the present invention will be described on the basis of FIG. 10. Meanwhile, control steps having the same reference numbers have the same functions or similar functions, and thus, the description thereof will be omitted unless necessary.

<<Step S20>>

It is the same as that in the first embodiment, and thus, will not be described.

<<Step S21>>

It is the same as that in the first embodiment, and thus, will not be described.

<<Step S22>>

It is the same as that in the first embodiment, and thus, will not be described.

<<Step S31>>

When the detection timing Spt arrives in step S20 and it is determined in step S21 that the boost circuit 104 is in the middle of the boosting operation, the boost voltage VH of the boosting capacitor 204 is detected in step S31. This detection of the boost voltage VH is executed every time when the detection timing arrives, which is different from the first embodiment. Thus, the legitimate boost voltage value VHa and the boost voltage value VHc upon appearance to which the error voltage value Ve has been added are detected together.

<<Step S23>>

It is the same as that in the first embodiment, and thus, will not be described.

<<Step S24>>

It is the same as that in the first embodiment, and thus, will not be described.

<<Step S32>>

When it is determined in step S24 that the switching element 202 is not turned on but in the off-state, the boost voltage value VH detected in step S31 is considered as the boost voltage value VHc added with the error voltage value Ve and discarded, or is invalidated without being handled as the legitimate boost voltage value in step S32. This corresponds to the off-period Toff of the switching element 202 in FIG. 7, and even if the detection of the boost voltage VH is executed at the detection timing Spt, the detected voltage is not reflected in control as a valid voltage value. The process is shifted to the end when the processing in step S32 is ended, and this control flow is ended. Further, the device waits for arrival of a next startup timing, again.

<<Step S26>>

It is the same as that in the first embodiment, and thus, will not be described.

<<Step S33>>

When setting of the on-flag is completed in step S26, it is determined in step S24 that the switching element 202 is turned on. Thus, the boost voltage value VH detected in step S31 is considered as the legitimate boost voltage value VHa and handled as a valid boost voltage value in step S33. This corresponds to the on-period Ton of the switching element 202 in FIG. 7, and the detected voltage is reflected in control as the valid boost voltage value VHa. The process is shifted to the end when the processing in step S32 is ended, and this control flow is ended. Further, the device waits for arrival of a next startup timing, again.

<<Step S28>>

It is the same as that in the first embodiment, and thus, will not be described.

<<Step S29>>

It is the same as that in the first embodiment, and thus, will not be described.

<<Step S34>>

When the setting of the on-flag is completed in step S29, it is determined in step S28 that the switching element 202 is turned off. Thus, the boost voltage value VH detected in step S31 is considered as the boost voltage value VHc added with the error voltage value Ve and discarded, or is invalidated without being handled as the legitimate boost voltage value in step S34. This corresponds to the off-period Toff of the switching element 202 in FIG. 7, and even if the detection of the boost voltage VH is executed at the detection timing Spt, the detected voltage is not reflected in control as a valid voltage value. The process is shifted to the end when the processing in step S32 is ended, and this control flow is ended. Further, the device waits for arrival of a next startup timing, again.

According to the present embodiment, it is possible to stabilize the boost voltage at the legitimate boost voltage value regardless of the temperature condition, and it is possible to inject the accurate amount of fuel from the fuel injection valve, thereby improving the fuel consumption.

Third Embodiment

Next, a third embodiment of the present invention will be described. The first embodiment has the characteristic that the detection timing is not set during the period in which the current flows into the boosting capacitor 204, and the second embodiment has the characteristic that the boost voltage value detected during the period in which current flows into the boosting capacitor 204 is not used. Meanwhile, the third embodiment has a characteristic that a predetermined detection period is set and a minimum value of the boost voltage VH detected at a detection timing in the detection period is considered as the legitimate boost voltage value VHa.

Figure 11:
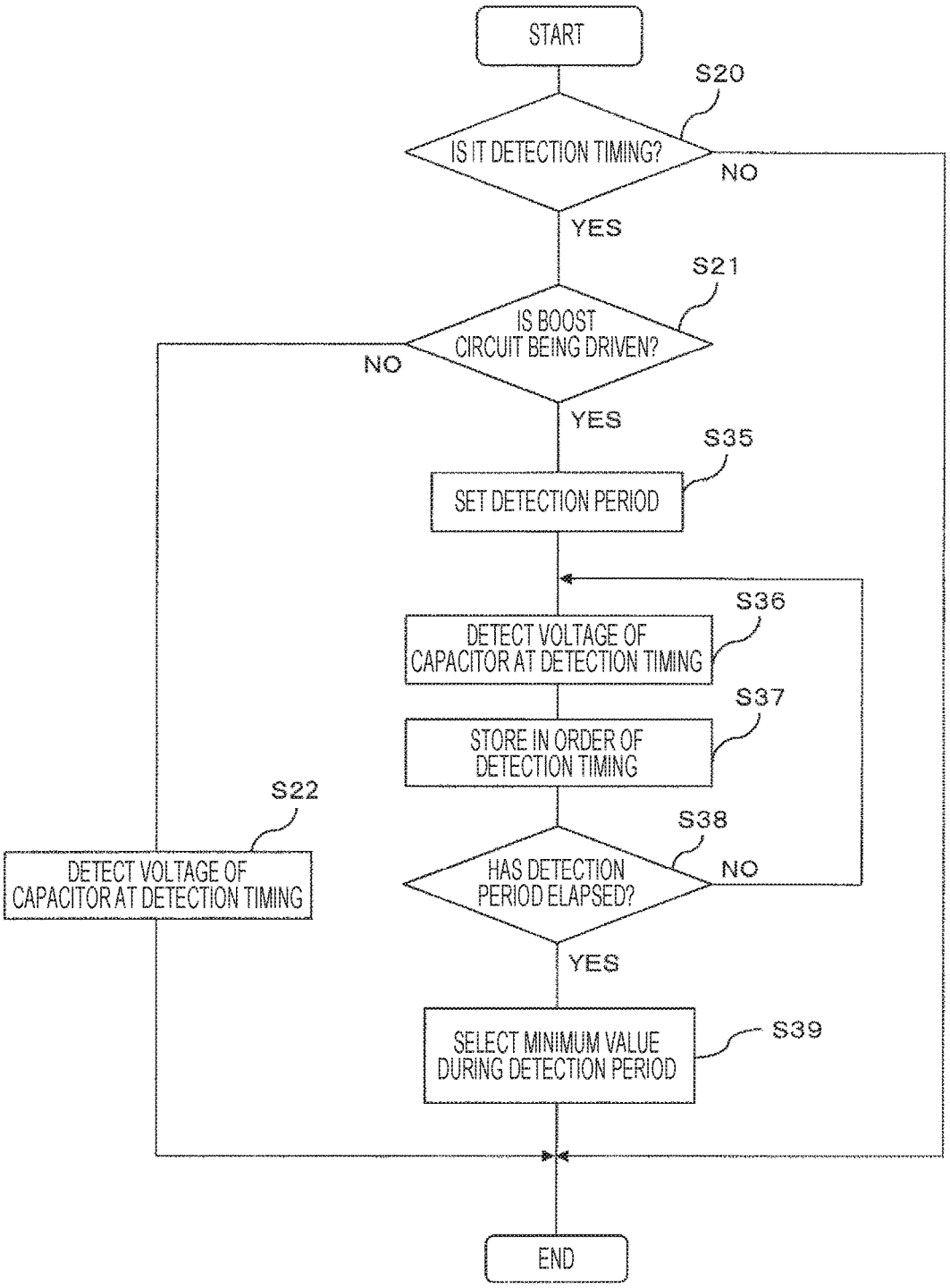
FIG. 11 is a control flow chart diagram for detection of a boost voltage according to a third embodiment of the present invention.

Hereinafter, the third embodiment of the present invention will be described on the basis of FIG. 11. Meanwhile, control steps having the same reference numbers have the same functions or similar functions, and thus, the description thereof will be omitted unless necessary.

<<Step S20>>

It is the same as that in the first embodiment, and thus, will not be described.

<<Step S21>>

It is the same as that in the first embodiment, and thus, will not be described.

<<Step S22>>

It is the same as that in the first embodiment, and thus, will not be described.

<<Step S35>>

When it is determined in step S21 that the boost circuit is in the middle of the boosting operation, a period for detection of the boost voltage is set in step S35. This detection period is arbitrary, but is set to a period at least including the on-period in which the switching element 202 is turned on during the boosting operation and the off-period in which the switching element 202 is turned off in FIG. 4.

<<Step S36>>

When the detection period is set in step S35, the boost voltage VH of the boosting capacitor 204 is detected in step S36. This detection of the boost voltage VH is executed every time when the detection timing arrives. Thus, the legitimate boost voltage value VHa and the boost voltage value VHc upon appearance to which the error voltage value Ve has been added are detected together.

<<Step S37>>

The boost voltage VH detected in step S36 is stored in a RAM area of a microcomputer which calibrates the boost circuit 102. The RAM area is configured to store the boost voltage VH in a time-series manner, and stores the boost voltage VH whenever the detection timing Spt arrives.

<<Step S38>>

When the boost voltage VH detected in step S37 is stored, whether the detection period set in advance has elapsed is determined in this step S38. The detection of the boost voltage VH is continued returning to step S36 if the boost voltage VH is not detected over the detection period, and the process is shifted to step S39 when it is determined that the detection period has elapsed.

<<Step S39>>

When it is determined in step S38 that the detection period has elapsed, selection of the boost voltage VH stored in the detection period is executed in step S39. The boost voltage VH is stored in the RAM area of the microcomputer to be associated in a time-series manner as described above, and it is configured such that a minimum boost voltage value is considered as the legitimate boost voltage value VHa and selected among N boost voltages VH detected for each detection timing in this step S39.

That is, it is possible to consider that the error voltage value Ve is not added to at least the minimum boost voltage value although the legitimate boost voltage value VHa and the boost voltage value VHc upon appearance to which the error voltage value Ve is added are detected together as the boost voltage VH detected during the boosting operation. The process is shifted to the end when the processing in step S39 is ended, and this control flow is ended. Further, the device waits for arrival of a next startup timing, again.

Incidentally, it is also possible to omit step S21 and execute control steps of step S35 and subsequent steps regardless of driving of the boost circuit 104 in the third embodiment.

According to the above-described present embodiment, it is possible to achieve an effect that control becomes easy since the number of control steps can be reduced, in addition to the action and effects described in the first embodiment and the second embodiment.

As described above, at least the boost voltage value detected when the current does not flow into the boosting capacitor during the boosting operation is taken as the legitimate boost voltage value according to the present invention. Thus, it is possible to stabilize the boost voltage at a legitimate boost voltage value regardless of the temperature condition, and it is possible to inject an accurate amount of fuel from a fuel injection valve, thereby improving fuel consumption.

Incidentally, the present invention is not limited to the above-described embodiments, and includes various modification examples. For example, the above-described embodiments have been described in detail in order to describe the present invention in an easily understandable manner, and are not necessarily limited to one including the entire configuration that has been described above. In addition, some configurations of a certain embodiment can be substituted by configurations of another embodiment, and further, a configuration of another embodiment can be also added to a configuration of a certain embodiment. In addition, addition, deletion or substitution of other configurations can be made with respect to some configurations of each embodiment.

REFERENCE SIGNS LIST

101 control unit
102 boost control circuit
104 boost circuit
105 fuel injection valve drive circuit
106 fuel injection valve
201 boost coil
202 switching element
203 current detection resistor
204 boosting capacitor
206 boost voltage detection unit
207 boost control unit
208 backflow preventing diode

The invention claimed is:

1. A fuel control device for an internal combustion engine that at least comprises: a boost coil which is connected to a DC voltage source and boosts a voltage of the DC voltage source; a switching element which causes a boost current to flow to the boost coil; a boosting capacitor which stores energy generated by the boost coil; a boost voltage detection unit which detects a boost voltage of the boosting capacitor; and a boost circuit which performs a boosting operation of storing the energy stored in the boost coil in the boosting capacitor when the boost voltage detected by the boost voltage detection unit decreases to a prescribed value or lower using a boost control unit which performs control of repeating turning on and off of the switching element until the boost voltage reaches the prescribed value, wherein the boost control unit executes an intermittent measurement mode in which a boost voltage value detected when no current flows to the boosting capacitor at least during the boosting operation is taken as a legitimate boost voltage value, and compares the detected legitimate boost voltage value with the prescribed value to control the boosting operation.

2. The fuel control device for the internal combustion engine according to claim 1, wherein in the intermittent measurement mode to be executed by the boost control unit, detection timing information is sent to the boost voltage detection unit when current does not flow into the boosting capacitor during the boosting operation, and a boost voltage value detected based on the detection timing information is taken as the legitimate boost voltage value.

3. The fuel control device for the internal combustion engine according to claim 2, wherein the boost control unit is configured using a boost control unit which performs control of the boost switching element when the boost voltage detected by the boost voltage detection unit decreases to the prescribed value or lower such that the boost switching element is turned on until current detected by the boost current detection unit reaches a set upper threshold, the boost switching element is turned off to cut off a boost current until a boost current value reaches a lower threshold after reaching the upper threshold, and the boosting operation of storing the energy stored in the boost coil in the boosting capacitor is repeated until the boost voltage reaches the prescribed value, and the boost control unit sends the detection timing information to the boost voltage detection unit after elapse of a predetermined standby time after the switching element is turned on.

4. The fuel control device for the internal combustion engine according to claim 1, wherein in the intermittent measurement mode to be executed by the boost control unit, successive detection timing information is sent to the boost voltage detection unit during the boosting operation, and a boost voltage value detected when current does not flow into the boosting capacitor is taken as the legitimate boost voltage value among boost voltages detected based on the detection timing information.

5. The fuel control device for the internal combustion engine according to claim 1, wherein in the intermittent measurement mode to be executed by the boost control unit, successive detection timing information is sent to the boost voltage detection unit, boost voltages detected based on the detection timing information in a predetermined detection period are stored during the boosting operation, and a minimum boost voltage value in the detection period is taken as the legitimate boost voltage value.

6. The fuel control device for the internal combustion engine according to claim 1, wherein the boost control unit executes the intermittent measurement mode when ambient temperature of the boosting capacitor is a predetermined value or lower.

* * * * *